United States Patent [19]

Roper

[11] 3,963,363

[45] June 15, 1976

[54] TRAFFIC CONTROL DEVICE

[76] Inventor: David H. Roper, 1732 Hill St., Santa Monica, Calif. 90405

[22] Filed: Mar. 4, 1974

[21] Appl. No.: 447,929

[52] U.S. Cl. ..... 404/11
[51] Int. Cl.[2] ..... E01F 9/00
[58] Field of Search ..... 404/11, 9, 10; 254/98

[56] References Cited

UNITED STATES PATENTS

| | | | |
|---|---|---|---|
| 2,649,341 | 8/1953 | Stepler | 404/9 |
| 2,910,270 | 10/1959 | Schultz | 254/98 |
| 3,447,429 | 6/1969 | Bowersox | 404/11 |
| 3,530,775 | 9/1970 | Bowersox | 404/11 |

FOREIGN PATENTS OR APPLICATIONS

| | | | |
|---|---|---|---|
| 772,855 | 12/1967 | Canada | 404/11 |

*Primary Examiner*—Nile C. Byers
*Attorney, Agent, or Firm*—Jack D. Puffer

[57] ABSTRACT

A pop up traffic control device stored in a cavity in the roadway when not in use and elevated to a predetermined height above the roadway by remote control when traffic control is required. The control device is attached to a follower which is engaged in the thread of a screw member. The screw member is caused to rotate by a remote signal thus causing the control member to be elevated.

5 Claims, 2 Drawing Figures

TRAFFIC CONTROL DEVICE

BACKGROUND OF THE INVENTION

In modern traffic control technology it is often required that traffic lanes and access roads be temporarily redirected or closed to traffic during certain peak traffic hours. This control is accomplished by setting in the roadway control devices indicating the traffic flow desired. In the past these devices have been set in the road by hand or more recently raised by pneumatic means from a remote site.

The shortcomings of the hand setting method are obvious in that the method requires a substantial amount of time for extensive control systems and, in addition poses a hazard to those placing the devices. The pneumatic devices, exemplified by the devices disclosed in U.S. Pat. Nos. 3,530,775 and 3,447,429, require close clearances within the device to prevent excessive air leakage and are subject to contamination by road dirt and sand, ice and snow and other debris often deposited on the highway. In addition, the installation of pneumatic lines in the road is a costly and time consuming procedure.

SUMMARY OF THE INVENTION

The invention disclosed herein overcomes the disadvantages recited above by providing a simple, mechanical device, which can be actuated by a variety of power sources, which can be made with no close clearances between parts and is less likely to become contaminated by roadway debris. This invention utilizes a course lead screw means rotated by a power source to raise the device by means of a follower attached to the raisable part of the device. The follower advances along the screw as it is rotated advancing the traffic marker into the proper place in the roadway. The device is retracted by reversing the procedure. Since the device requires no precise clearances between operating parts and uses only simple mechanical components its reliability and longevity of operation is assured.

DESCRIPTION OF THE PREFERRED EMBODIMENT

Figure 1:
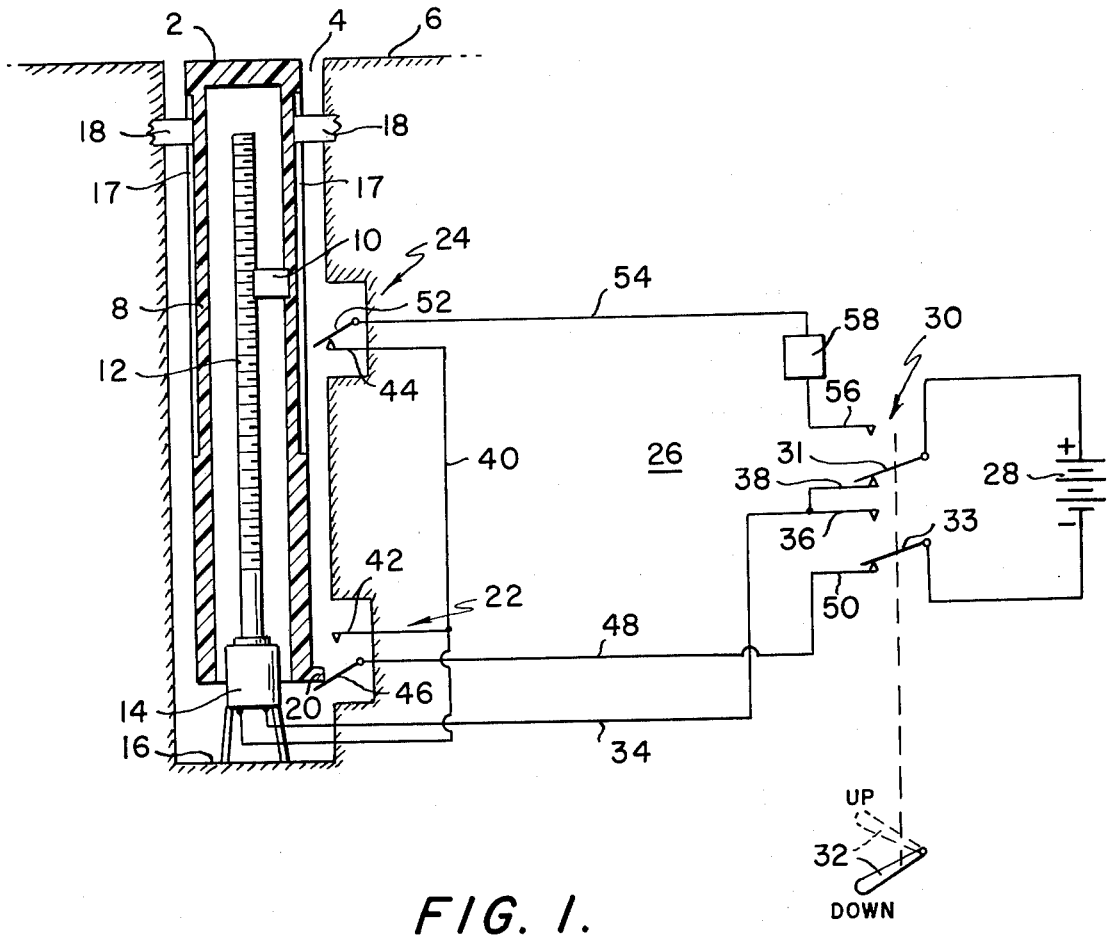
FIG. 1 is a sectional view of the invention and an electrical schematic of a control system.
Figure 2:
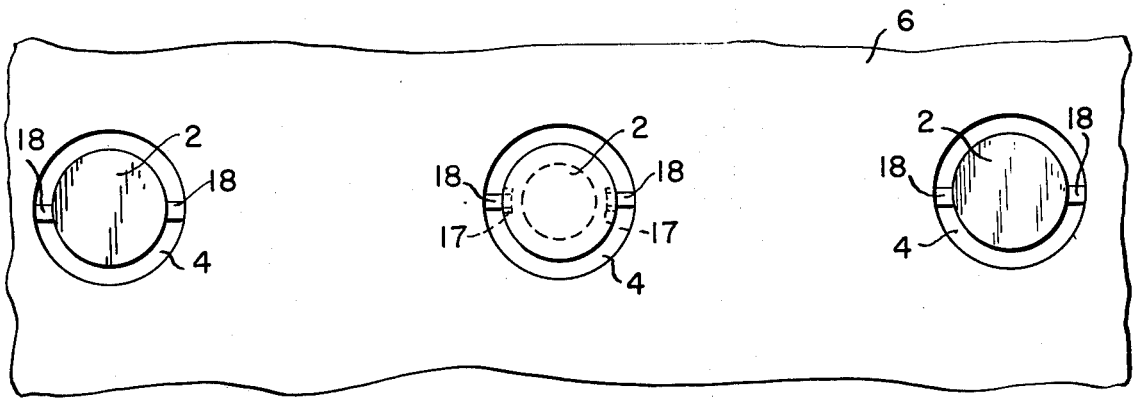
FIG. 2 is a plan view of FIG. 1.

Referring now to FIG. 1, the marker device of the invention is shown generally at 2 recessed in a well, 4 in the surface of a roadway shown generally at 6. The raisable market cylinder 8, typically made of a semi rigid plastic or rubber has attached to its inside surface a screw follower 10. This follower is engaged in the threads of the actuating screw 12. The screw is attached to the output shaft of a motor 14 which is mounted at the bottom surface 16 of the well 4. As is shown in FIG. 2, there are provided in the wall of the well 4 opposed anti-rotation lugs 18 which engage corresponding slots 16 in the outer wall of the tube 8. At the foot of the tube 8 there is provided a switching lug 20 for actuating limit switches shown schematically at 22 and 24.

The motor 14 of the preferred embodiment is a reversible D.C. motor. This motor which raises and lowers the marker 2 is controlled by a switching circuit shown generally at 26. The circuit consists of a D.C. power source shown as battery 28. This power source is connected to the motor 14 and limit switches 22 and 24 through a double pole, double throw switch 30, controlled by actuator 32 to select the desired position of the marker. One side of the motor winding is connected to battery 28 by means of lead 34 connected to contacts 36 and 38 of switch 30. The other side of the motor winding is connected by lead 40 to contact 42 of limit switch 22 and to the contact 44 of limit switch 24. The wiper of limit switch 22 is connected to contact 50 of switch 30 and the wiper 52 of limit switch 24 is connected to contact 56 of switch 30 by lead 54.

OPERATION

The device is shown in FIG. 1 in the stowed or unused position. Power to the motor 14 is interrupted by open switch 22 held open by switch lug 20. When it is desired to raise the marker 8 above the road surface actuator 32 is moved from the position shown to the "up" position shown in dotted lines. This causes wipers 31 and 33 of switch 30 to break contact with contacts 38 and 50 respectively and to contact contacts 56 and 36. This action completes the power circuit to the motor from the battery. The positive side of the battery is connected to the motor through lead 54, through closed switch 24 and lead 40. The negative side of the battery is connected to the other side of the motor by way of contact 36, and lead 34. This action causes motor 14 to turn screw 12. As the screw turns follower 10 advances along the thread carrying marker 8 upward with it. When lug 20 engages the wiper 52 of limit switch 24 and opens this switch, power to the motor is interrupted and the marker remains in the raised position. When the marker is to be lowered the reverse action takes place. When the marker is raised switch 22 closes and provides a power path to the motor of opposite polarity when the actuator 32 of switch 30 is placed in the "Dn" position.

In addition there is provided an automatically reset circuit breaker 58 for interrupting power to the motor in the event that the device becomes stalled between the fully raised and fully lowered position. This condition could occur in the case where a car driving over the marker during deployment stops on the marker and prevents further movement. In this case the circuit breaker will interrupt power to the motor until the restraining force is removed.

While in the preferred embodiment the actuating means is shown as an electrical system, it will be obvious to those skilled in the art that any form of actuation may be used to provide rotary motion to the screw 12. Hydraulic or pneumatic motors could be used in an equivalent circuit to that shown. In its simplest form the screw 12 could be turned by means of a hand crank. However this method is not compatible with computerized systems of modern traffic control.

In another embodiment of the invention the device could be held in the retracted position by a latch means against a compressed spring and could be released from a remote site and pop into position by the spring force. This device could then be lowered to the stored position by a screw means as described above while at the same time compressing the actuating spring in preparation for the next deployment.

Thus it can be seen that there is herein provided a simple, reliable traffic control marker adaptable to automatic remote control systems which contains few parts and allows for ample clearances between these parts to avoid malfunction through contamination from road debris. The portion of the device above the road surface is made entirely of pliable material which will not cause damage to cars in the event of a collision. Since the device does not rely on fluid pressure in the marker as the prior art devices do the marker will tolerate substantial physical damage before replacement is required.

While specific embodiments of the invention have been described and illustrated, it is to be understood that these embodiments are provided by way of example only and that the invention is not to be construed as being limited thereto, but only by the proper scope of the following claims.

What is claimed is:

1. A traffic control device retractable into an opening in a roadway comprising:

resilient deformable marker means disposed in said opening for movement in and out of said opening;

rotary motor power means having an output shaft and mounted in said opening;

rotary actuator means connected to the shaft of said motor means and further comprising a screw means rotated by said power means and a follower means attached to said marker means and in engagement with threads on said screw means whereby rotation of said screw means causes said marker means to move into and out of the opening; and control means operatively related to said motor power means for controlling said power means.

2. A traffic control device retractable into an opening in a roadway comprising:

resilient deformable hollow marker means having a longitudinal axis generally orthogonal to the plane of the roadway surface and disposed in said opening for movement in and out of said opening;

rotary motor power means having an output shaft and mounted in said opening;

rotary actuator means connected to the output shaft of said power means for rotation therewith, said actuator means comprising a cylindrical screw means having a longitudinal axis, said screw means being arranged in the hollow interior of said marker means such that its longitudinal axis is generally coincident with the longitudinal axis of said marker means and rotated by said power means; follower means attached to said marker means and in engagement with the threads on said screw means whereby rotation of said screw means causes said marker means to move into and out of the opening; and control means operatively related to said motor power means for controlling said power means.

3. The traffic control device of claim 2 and further comprising guide means attached to the interior wall of the opening in the roadway and operably connected to the exterior surface of said marker means for guiding said marker means in and out of said opening and preventing rotation thereof about its longitudinal axis.

4. The traffic control device of claim 3 wherein said rotary motor means is an electric motor.

5. The traffic control device of claim 3 wherein the rotary motor means is a hydraulic motor.

* * * * *